United States Patent [19]

Kawamata

[11] 4,111,142

[45] Sep. 5, 1978

[54] APPARATUS FOR HEATING SEAMS OF CANS

[75] Inventor: Kiyoshi Kawamata, Ohmiya, Japan

[73] Assignee: Nihon Seikan Kabushiki Kaisha, Ohmiya, Japan

[21] Appl. No.: 646,938

[22] Filed: Jan. 6, 1976

[30] Foreign Application Priority Data

Jan. 6, 1975 [JP] Japan ..... 50-4344
Feb. 24, 1975 [JP] Japan ..... 50-25191

[51] Int. Cl.[2] ..... F16B 11/00

[52] U.S. Cl. ..... 113/1 E; 113/120 Y; 156/497; 219/368

[58] Field of Search ..... 156/497, 499; 113/121 A, 121 C, 1 E, 1 R, 120 R, 120 Y; 53/375; 432/230; 219/373, 374, 368

[56] References Cited

U.S. PATENT DOCUMENTS

| | | | |
|---|---|---|---|
| 1,660,052 | 2/1928 | Shepherd | 219/368 |
| 2,456,781 | 12/1948 | Hardoy | 219/377 |
| 2,900,762 | 8/1959 | Leighton | 423/230 |
| 3,488,244 | 1/1970 | Lepisto | 53/375 X |
| 3,720,565 | 3/1973 | Cavanna | 156/497 |
| 3,909,330 | 9/1975 | Schmermund | 156/497 X |

*Primary Examiner*—Leon Gilden
*Attorney, Agent, or Firm*—Wenderoth, Lind & Ponack

[57] ABSTRACT

An apparatus for heating the adhesive-coated seam portions of a can of square cross-section including the side seam and curled peripheral end seam for hermetically sealing the can, and which comprises heated-air guiding means formed by two plate members arranged opposite each other and having a narrow air-passage formed by the two plate members and located opposite the seam portions of the can carried by conveyer means, and a heat generator therein for supplying heated air.

9 Claims, 12 Drawing Figures

APPARATUS FOR HEATING SEAMS OF CANS

BACKGROUND OF THE INVENTION

The present invention relates to an apparatus for heating the adhesive-coated seam portions of cans of square cross-section carried by conveyor means, and more particularly to an apparatus of the character which can supply heated air through a narrow air-passage formed by two plate members located opposite the seam portions so that the adhesive material applied to the seam portions can be melted to hermetically seal the cans.

Conventional large-capacity sheet metal cans or containers of square cross-section, usually known as 16-liter cans, have the side seam and curled peripheral end seam thereof hermetically joined by soldering means. It is known that the use of solder complicates the soldering process itself, and makes it difficult to dispose of the water used for washing the soldered cans because of the presence of metal grains in the water.

There is also known a non-soldering process developed hereto for tightly joining the seam portions. In accordance with the known non-soldering process, heat treatment is provided for heating the adhesive-coated seams of a formed container and melting the adhesive material so that it can expand uniformly all over the seams, and pinholes and other tiny punctures that may damage the airtightness of the container can be eliminated. However, this presents disadvantages from the standpoint of heat efficiency and fuel economy, since the heater is provided for heating the whole container, but not locally.

The present invention has overcome the above disadvantages of heat efficiency and fuel economy, and provides heating means by which only the seam portions of containers carried by conveyer means at very high speeds can be heated to a proper temperature.

SUMMARY OF THE INVENTION

It is therefore one object of the present invention to provide a heating apparatus which heats only the adhesivecoated seam portions of formed containers carried by conveyer means at very high speeds.

It is another object of the present invention to provide a heating apparatus which heats only the seam portions of cans uniformly and with better heat efficiency.

A more particular object of the present invention is to provide a heating apparatus which comprises heated-air guiding means formed by two plate members arranged opposite each other and having a narrow air-passage formed by the two plate members located opposite the seam portions of cans carried by conveyer means, and a heat generator therein for supplying heated air, so that the heated air supplied by the generator can be made to pass in uniformly flat forms through the air passage and be concentrated on the seam portions.

Other objects and advantages of the present invention will become apparent from the following specification and accompanying drawings.

DESCRIPTION OF THE PREFERRED EMBODIMENTS

Figure 1:
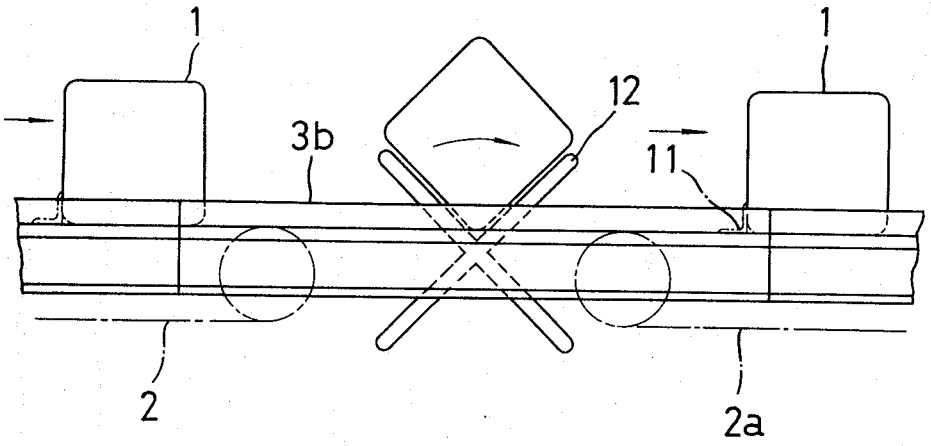
FIG. 1 is a front view of a first preferred embodiment of heating apparatus according to the invention.
Figure 2:
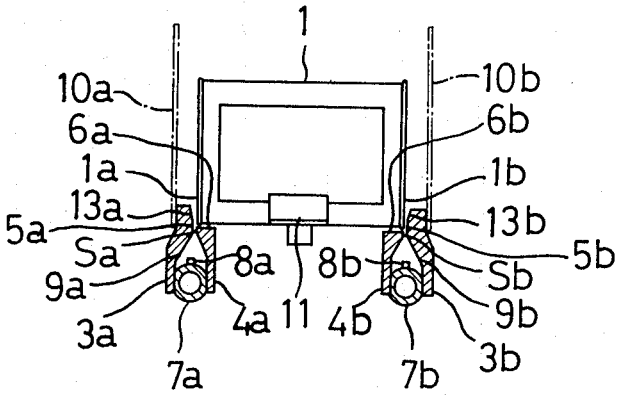
FIG. 2 is a partially cross-sectional side view of FIG. 1.
Figure 3:
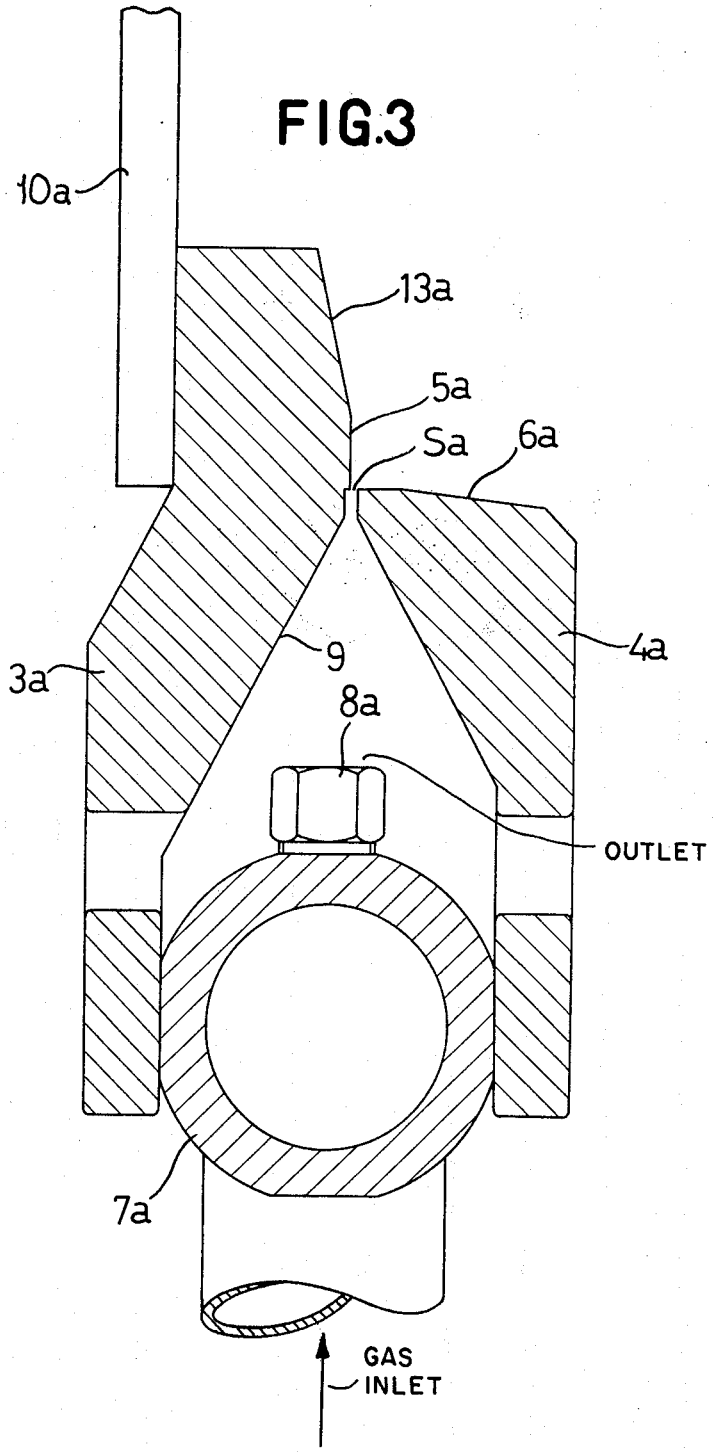
FIG. 3 is an expanded cross-sectional view of FIG. 1, showing the heated-air guiding means and heat generator.

The present invention will further be described by way of several preferred embodiments thereof by reference to the accompanying drawings in which:

Referring first to FIGS. 1 to 3, a can 1 of square cross-section is shown lying sideways, and heated-air guiding members 3*a*, 4*a* and 3*b*, 4*b* are provided along and opposite conveyers 2, 2*a* which carry the can 1 in the right-angle direction relative to the longitudinal side of the can body. As shown, the guiding members 3*a*, 4*a* and 3*b*, 4*b* are located opposite the curled peripheral end seam portions 1*a*, 1*b* of the can 1, said seam portions 1*a*, 1*b* being formed by curling the peripheral margin of the can body with that of the end plate. The guiding members 3*a*, 3*b* have portions 5*a*, 5*b* of a length which extends along the end plate of the can 1, and have one face or inner side thereof spaced parallel relative to the end plate, so that the portions 5*a*, 5*b* can cover part of the curled seam portions 1*a*, 1*b* of the can 1.

The guiding members 4*a*, 4*b* have flat end portions 6*a*, 6*b* spaced in parallel relative to the longitudinal side of the can 1 so that the portions 6*a*, 6*b* can cover the lateral side of the curled seam portion 1*a*, 1*b*. As seen from FIG. 2, the guiding members 3*a*, 4*a* and 3*b*, 4*b* are arranged in parallel opposite each other, respectively, to form a narrow air-passage S*a*, S*b* through which heated-air is forced and is applied to the portions 1*a*, 1*b* for heating. Heated air is supplied by gas burners 7*a*, 7*b* through nozzles 8*a*, 8*b* thereof, and strikes the slanted inner surfaces 9*a*, 9*b* of the members 3*a*, 3*b* so that it flows in uniformly flat forms through the air passages S*a*, S*b*. It should be noted that flowing through the air passages S*a*, S*b*, heated air is made to be distributed to a substantially average volume so that it can heat the portions 1*a*, 1*b* uniformly.

As shown, lagging members 10*a*, 10*b* are provided for preventing the escape of heated air, the members have the lower ends thereof rigidly secured to the upper outer sides of the members 3*a*, 3*b* and the length thereof is sufficient to extend slightly above the lying can 1. In the drawing, reference numeral 11 denotes a pawl provided on the conveyer 2, 2*a* for carrying the can 1, and reference numeral 12 denotes means which can turn the can 1 through an angle of 90°. The inner sides 13*a*, 13*b* of the members 3*a*, 3*b* have a slightly outwardly slanted face which serves to place the can 1 in position.

Figure 4:
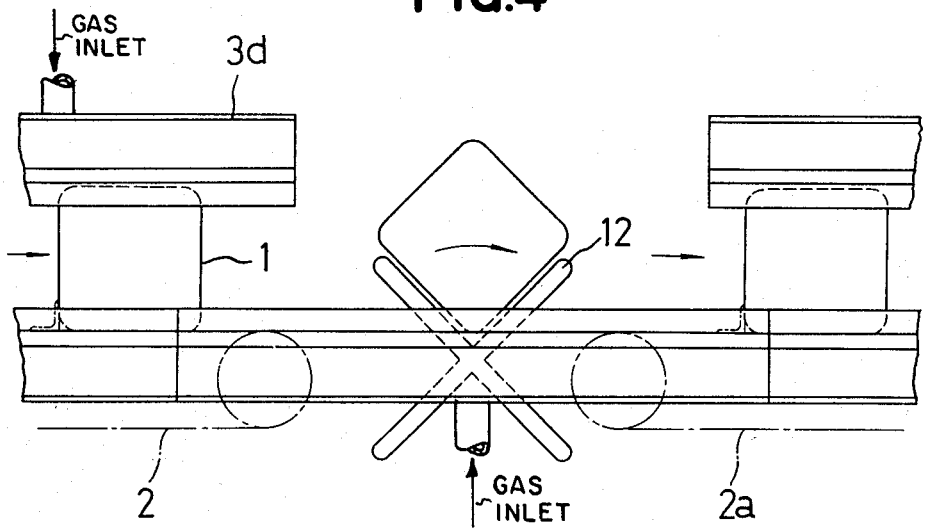
FIG. 4 is a front view of a second preferred embodiment of the heating apparatus according to the invention.
Figure 5:
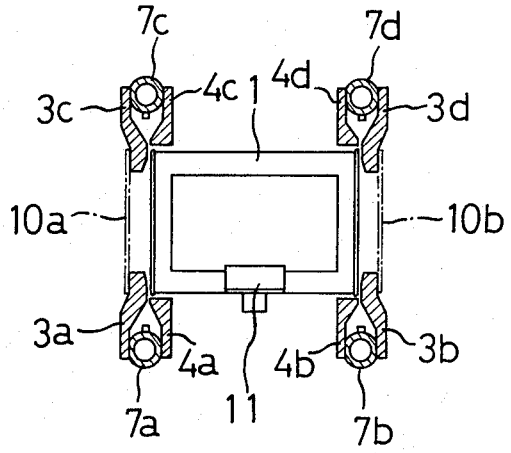
FIG. 5 is a partially cross-sectional side view of FIG. 4.

Referring next to FIGS. 4 and 5, another preferred embodiment of the invention will be illustrated in which four sets of guiding members and heat generators are provided, which are placed opposite the four corners of the can 1. As particularly shown in FIGS. 4 and 5, guiding members 3*c*, 4*c* and 3*d*, 4*d* are provided above the members 3*a*, 4*a* and 3*b*, 4*b* opposite the members 3*c*, 4*c* and 3*d*, 4*d*, respectively, and have has burners 7*c* and 7*d* therein.

Figure 6:
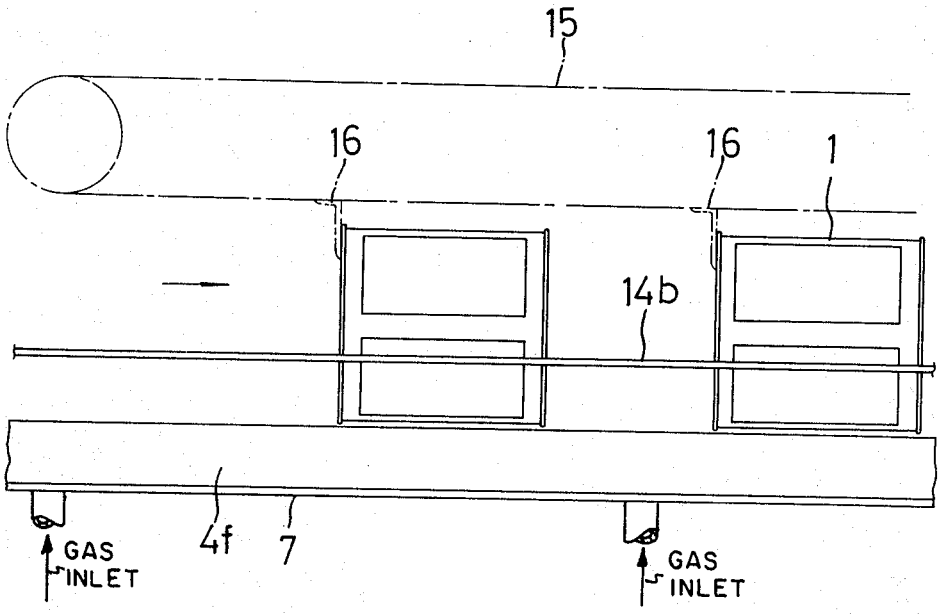
FIG. 6 is a front view of a third preferred embodiment of heating apparatus according to the invention.
Figure 7:
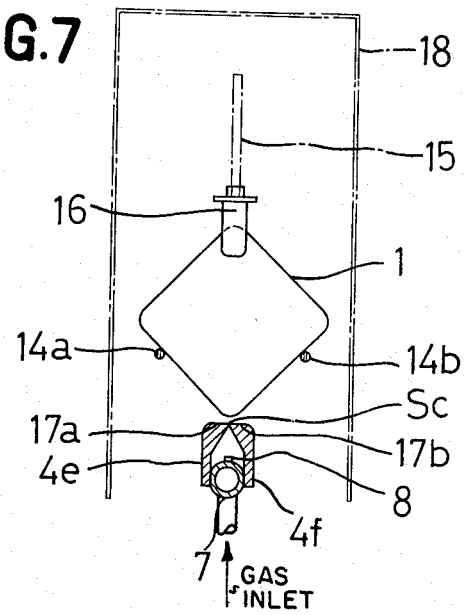
FIG. 7 is a partially cross-sectional side view of FIG. 6.
Figure 8:
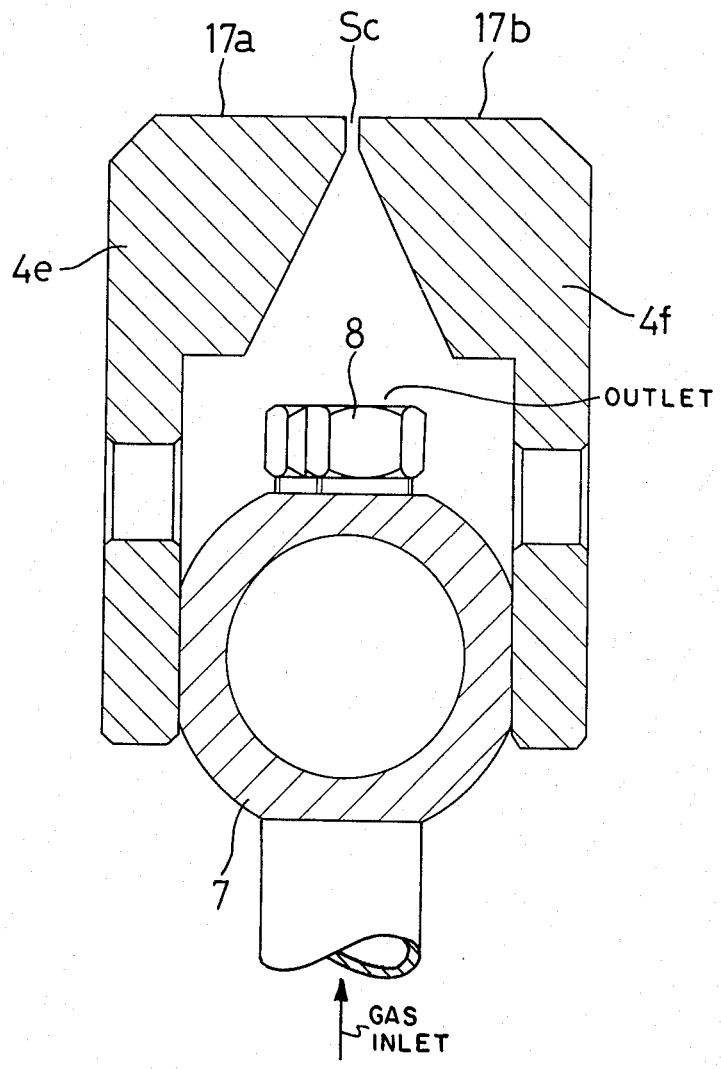
FIG. 8 is an expanded cross-sectional view of FIG. 6, showing the heated-air guiding means and heat generator.

A further preferred embodiment is shown in FIGS. 6, 7 and 8, in which a can 1 is placed and carried by conveyer 15 in such a manner that its side seam is located opposite the heating apparatus for heating. In this embodiment, the can 1 is supported by guiding members 14*a*, 14*b* provided for supporting the opposite sides of the can 1, and is carried by pawl 16 on the conveyer line. As seen from FIG. 8, the side seam of the can 1 is located opposite the heating apparatus provided below the can 1. The heating apparatus shown in FIG. 8 includes heated-air guiding members 4*e* and 4*f* arranged opposite each other and each having the upper end 17*a*, 17*b* of flat surface opposite the side seam of the can 1. The guiding members 4*e* and 4*f* are so arranged opposite each other as to form a narrow air passage S*c* which is also located opposite the side seam of the can 1 and through which heated air is forced to flow. A lagging member 18 is provided for preventing the heated air to escape from the atmosphere surrounding the conveyer line, cans carried on the conveyer line and heating apparatus. In the drawing, reference numeral 7 denotes a gas burner, and reference numeral 8 denotes a nozzle of the gas burner 7.

Figure 9:
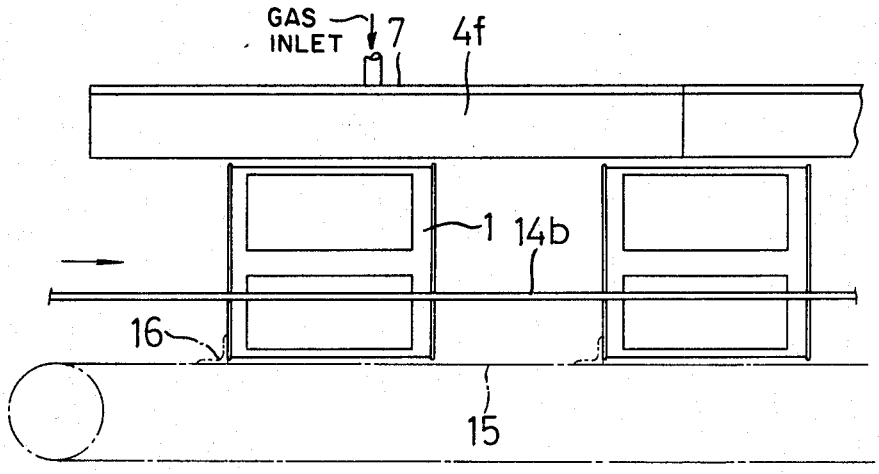
FIG. 9 is a front view of a fourth preferred embodiment of heating apparatus according to the invention.
Figure 10:
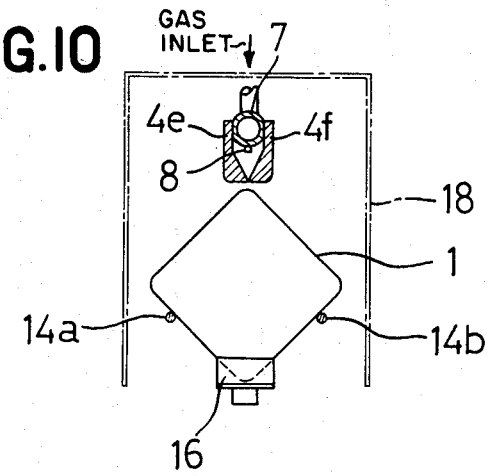
FIG. 10 is a partially cross-sectional side view of FIG. 9.

A still further emobodiment is shown in FIGS. 9 and 10, in which the heating apparatus shown in FIG. 7 is located above the conveyer line and opposite the side seam of the can 1. As seen in this case, cans are placed and carried by the conveyer in such a manner that their side seams are heated by the heating apparatus above the cans. All similar members found in the embodiment of FIG. 7 have the same reference numerals in FIG. 9. However, it seems that the embodiment of FIG. 7 is preferable and more effective from the fact that the heated air or flame usually goes up.

Figure 11:
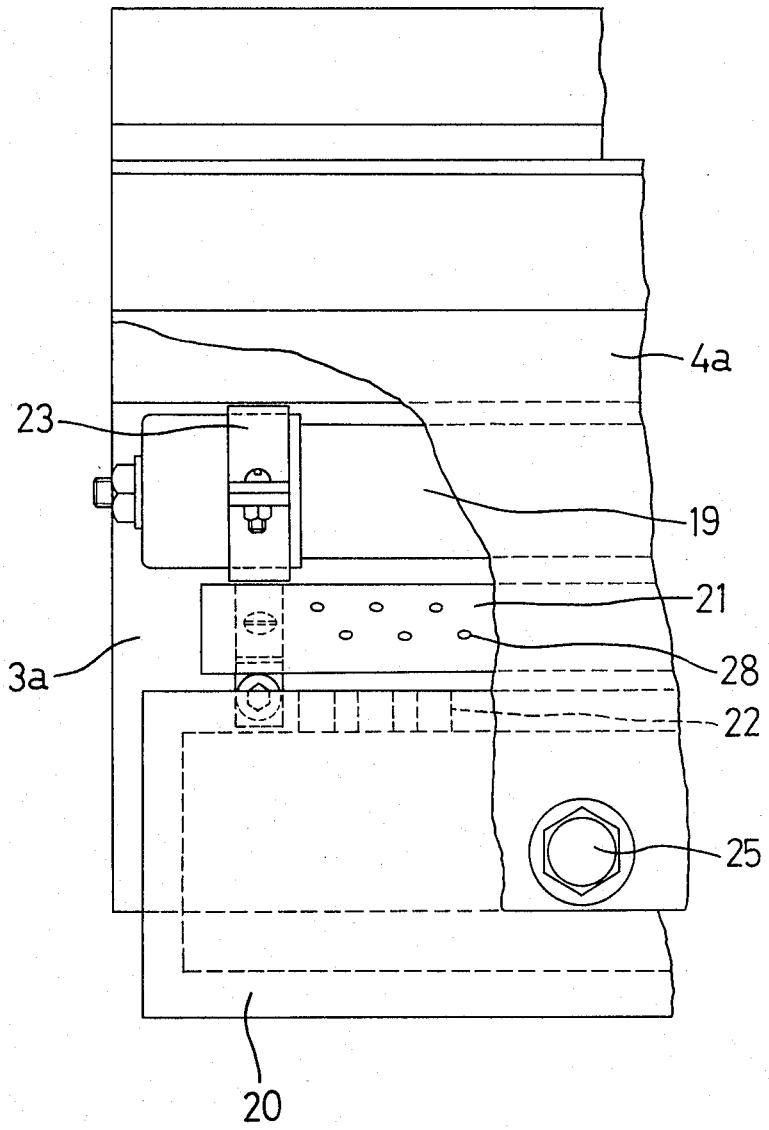
FIG. 11 is a front view, partly cut away, of a fifth preferred embodiment of heating apparatus according to the invention.
Figure 12:
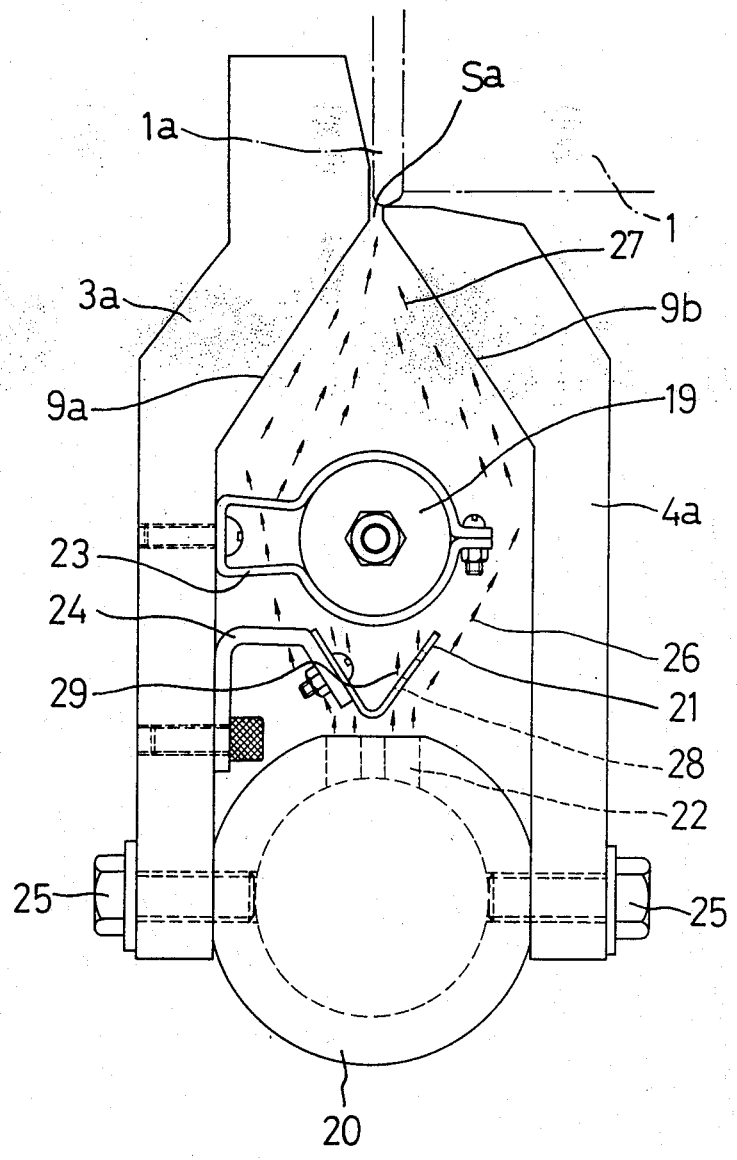
FIG. 12 is a side view of FIG. 11, showing the heated-air guiding means and heat generator.

FIGS. 11 and 12 indicate another embodiment in which an electrical heater tube and a blast tube are provided in place of the gas burner. In this embodiment, an infrared ray light 19 is provided inside the guiding members 3*a* and 4*a*, and a blast pipe 20 is provided below and parallel to the light 19 in parallel to the light 19. Furthermore, a V-shaped member 21 is provided as shown between the light 19 and the blast pipe 20, which can separate the air flow from the blast pipe 20 in two directions. As shown, the light 19, blast pipe 20 and Vee-shape member 21 are arranged in alignment so that the air blown from the openings 22 provided through the wall of the blast pipe 20 can hit the sides of the Vee-shape member 21 which guides substantially equal amounts of the air on the opposite sides of the light 19. In the drawing, reference numerals 23 and 24 denote hardwares with which the light 19 and Vee-shape member 21 are rigidly secured in position, respectively, and reference numeral 25 denotes bolts which fix the blast pipe 20 in position. In the above embodiment, the air from the openings 22 of the blast pipe 20 hits the sides of the Vee-shape member 21, and is separated in the two directions as indicated by the arrows 26, flowing on the opposite sides of the light 19. As it flows across the sides of the light 19, the air is heated by the light 19 to desired temperatures, hitting the slanted inner surfaces 9*a* and 9*b* of the members 3*a* and 4*a* as indicated by the arrows 27, so that the heated air can pass in uniformly flat forms through the narrow air-passage S*a*. As shown in FIG. 12, the Vee-shape member 21 is provided with a plurality of openings 28 through which air can also flow, passing very close to the light 19 as indicated by the arrows 29. This provides an advantage from the fuel economy and heat efficiency.

In accordance with the invention described heretofore, the two heated-air guiding members are arranged opposite each other so as to form a narrow air-passage which is located opposite the conveyer line carrying cans thereon, and a heat generator is provided inside the guiding members. The narrow air-passage is exactly located opposite the adhesive coated joint or seam portions of a can. The heated air from the generator is guided by the guiding members toward the narrow air-passage, through which the air is forced to pass so that it is distributed uniformly and locally. It should then be noted that the distribution of the heated air is localized so that it heats only the joint or seam portions of the can to a uniform temperature. Since the heat distribution is so localized that heat is applied to only the joint or seam portions of the can and not to the whole can, it is possible to obtain better heat efficiency and fuel economy, and since there is a lagging member which can prevent the heated air from escaping from the atmosphere surrounding the heating apparatus, better heat efficiency and fuel economy can be achieved.

The heating process may first start with any of the two adhesive-coated seam portions of a can, the curled peripheral end seam and the side seam. However, it is rather preferable that it should first start with the side seam of the can. If the side seam is first started with, it provides better seaming results with regard to the points at which the heat process is repeated.

Although the invention has been described with reference to the several preferred embodiments thereof, it should be understood that various changes and modifications may be made without departing from the scope and spirit of the invention.

What is claimed:

1. An apparatus for heating the adhesive-coated seams of cans while said cans are on a continuous conveyor, said seams including an end seam produced by curling the margin of the end plate of said can with the margin of the body of said can and a longitudinal side seam along the body of said can, said apparatus comprising:

at least one heat supply means for heating and blowing a flow of air;

at least one heated air guide means adjacent to said conveyor and at least partially surrounding said heat supply means and having an opening in one side thereof for concentrating the flow of blowing heated air from said heat supply means through said opening against said seams, said heated air guide means comprised of:

first and second guiding members spaced opposite and spaced from each other with a narrow slit therebetween, whereby said heated air from said heat supply means is blown against said seam through said slit; and heat holding means at least partially surrounding said conveyor for preventing the flow of heated air blowing through said slit between said guiding members from passing directly into the atmosphere surrounding said apparatus.

2. An apparatus as claimed in claim 1, wherein said first guiding member has a substantially flat surface parallel to and coplanar with said slit.

3. An apparatus as claimed in claim 2, wherein said second guiding member opposite said first guiding member has an extended vertical portion extending upward from said slit.

4. An apparatus as claimed in claim 1, wherein a plurality of heated air guide means are provided, at least one air guide means for heating said end seam and one air guide means for heating said longitudinal side seam of said can body.

5. An apparatus as claimed in claim 1, wherein said first and second guiding members have horizontal surfaces spaced from each other across said slit.

6. An apparatus as claimed in claim 1, wherein said heat generating means is comprised of a gas burner.

7. An apparatus as claimed in claim 1, wherein said heat generating means is comprised of an electric heater tube and an air blast pipe below said electric heater tube.

8. An apparatus as claimed in claim 1, wherein said heating generating means is comprised of an electric heater tube, an air blast pipe below said electric heater tube, and substantially Vee-shaped member means between said electric heater tube and said air blast pipe for separating air from said air blast pipe into two directions.

9. An apparatus as claimed in claim 8, wherein said Vee-shaped member means has a plurality of air passage openings therethrough sapced at regular intervals.

* * * * *